United States Patent [19]

Binder et al.

[11] Patent Number: 4,538,321

[45] Date of Patent: Sep. 3, 1985

[54] APPARATUS FOR REMOVING EXCESS DEVELOPER PARTICLES ON THE SURFACE OF A RECORDING ELEMENT

[75] Inventors: Jean-Jacques Binder, Valdoie; Bernard Cherbuy, Belfort, both of France

[73] Assignee: Cii/Honeywell Bull (Societe Anonyme), Paris, France

[21] Appl. No.: 505,980

[22] Filed: Jun. 20, 1983

[30] Foreign Application Priority Data

Jul. 22, 1982 [FR] France ..... 82 12831

[51] Int. Cl.[3] ..... G03G 15/00

[52] U.S. Cl. ..... 15/306 R; 355/15

[58] Field of Search ..... 15/306 R, 308; 355/15

[56] References Cited

U.S. PATENT DOCUMENTS 3,161,544 12/1964 Berry ..... 118/637
4,014,065 3/1977 Hudson ..... 15/306 R
4,233,382 11/1980 Edwards et al. ..... 430/39
4,271,559 6/1981 Blumenthal ..... 15/308
4,304,026 12/1981 Borostyan ..... 15/308

FOREIGN PATENT DOCUMENTS 3006739 2/1980 Fed. Rep. of Germany .

*Primary Examiner*—Chris K. Moore
*Attorney, Agent, or Firm*—Kerkam, Stowell, Kondracki & Clarke

[57] ABSTRACT

The invention relates to a device that permits removal of excess developer particles on the surface of a recording element and comprises a suction conduit (22) having at one end a port (23) in the form of a slot and at its other end a cylindrical chamber (25) which communicates with said conduit. The generators of the chamber run parallel to the port (23). The chamber includes a suction port (32) which is connected to a suction source, and an air inlet port (31) which discharges into the free atmosphere (31).

20 Claims, 7 Drawing Figures

APPARATUS FOR REMOVING EXCESS DEVELOPER PARTICLES ON THE SURFACE OF A RECORDING ELEMENT

BACKGROUND OF THE INVENTION

1. Field of the Invention

The present invention relates to an apparatus for removing excess developer particles on the surface of a recording element. Such an apparatus finds particular, though not exclusive, application in magnetic printers.

2. Description of the Prior Art

In present-day data procesing equipment, fast printers are finding increasing application, in which the printing of the characters is effected without requiring raised type impacting on a recipient sheet of paper. These printers, called non-impact or strikeless transfer printers, ordinarily comprise a recording element which ususally consists of a rotary drum or an endless belt, on the surface of which sensitized areas can be formed by electrostatic or magnetic means. These sensitized areas are also called latent images and correspond to the characters or images to be printed. These images are then developed, that is to say, made visible, with the aid of a powdery developer deposited on the recording element. This recording element is brought into contact with a sheet of paper so as to permit the developer particles which are retained by sensitized areas of said element to be transferred onto this sheet in order to be fixed definitively thereon.

To apply these solid developer particles to the recording element of a printer of this type, various applicator means can be used, such as, for example, that described and shown as an accessory in U.S. Pat. No. 3,161,544. However, despite all the care taken during the construction of these devices, it is difficult to prevent the developer particles from being deposited not only in excess on the sensitized areas of the recording element, but also, however slightly, outside said areas. This phenomenon is attributed to the fact that the particles, when they recharged with moisture or static electricity, or when they undergo softening which, however, slightly, makes them more or less sticky, adhere to the surface with which they have been brought into contact. The excessive deposit of developer particles on the sensitized areas of the recording element is undesirable because, when this developer is transferred onto the sheet of recipient paper, the developer that has been deposited according to the pattern of the image formed by these sensitized areas may be spread out and, thereby, blurring the image. On the other hand, the deposit of development particles outside the sensitized areas of the recording element itself is undesirable because of the fact that these particles, when they are transferred onto the paper, form a background which reduces the contrast between the transferred image and the original background of the paper.

Various devices have been used in the prior art to eliminate the excess developer on the surface of the recording element. A device of this type is known in which a mass of development particles brought into contact with the surface of the recording element and downstream of the applicator means electrically discharges the particles which adhere to this element outside the sensitized areas, so that these discharged particles are dislodged from the recording element and adhere to this mass. However, the use of such a device has not given complete satisfaction because it does not always ensure a complete electrical discharge of the particles and, therefore, does not ensure the elimination of the developer particles which continue to exist on the recording element outside the sensitized areas thereof. Furthermore, such a device cannot be used to remove the excess particles on the recording element of an electrostatic printer, because this device would risk, when capturing the electric charges of said element, erasing the sensitized areas thereof.

To overcome these drawbacks, a device has been proposed that contains a chamber connected to a pneumatic pressure member and which has opposite the surface of the recording element an opening through which the air sent under pressure into the chamber escapes. This opening is dimensioned such that the escape of air takes place in the form of an air jet which strikes the surface and, thus, blasts away the excess of developer particles that have adhered to said surface. However, this device, although it has given excellent results, still has the drawback that it discharges the particles that have been blasted away by the jet of air into the atmosphere, causing a pollution and always undesirably ending up or coating those who are near the machine.

Another known device operates in the manner of a vacuum cleaner. The excess developer particles are removed without polluting the atmosphere. Such a device has been described and shown in French Pat. No. 2,322,395, which corresponds to U.S. Pat. No. 4,014,065 issued to Hudson on Mar. 29, 1977, and comprises on one side a chamber usually having a cylindrical form and provided with an inlet and outlet opening, each of which is positioned at one of the two ends of the chamber. The outlet opening is connected to a source of partial vacuum and, on the other side, a conduit or supply tube with a constant cross section communications, at one of its ends, with the inlet opening of the chamber. The other end of said conduit has an orifice in the form of a slot positioned at a very short distance from the surface of the recording element. In this device, the orientation of the chamber is such that its generators are orthogonal to the direction of lengthening of the orifice in the form of the slot in the conduit. Moreover, the ratio of the surface of the cross section of the inlet opening to the outlet opening of the chamber is very small, i.e., less than 0.1, which ensures an air flow which is practically uniform throughout the width of the inlet opening of the chamber. It has been observed that in such a device the developer particles which have been drawn in were not always carried appropriately through the chamber during their passage, and the accumulated particles ended up on the wall of the chamber causing a considerable reduction in the exhausting capacity of the apparatus in the long run and, hence, a relatively heavy clogging of the conduit.

SUMMARY OF THE INVENTION

The present invention overcomes this drawback and proposes a device that can effectively draw in the excess developer particles that have been deposited on the surface of the recording element without the drawn-in particles being accumulated other than on filters that have been provided for their collection. The result is that plugging is practically eliminated so that the device can operate under optimum conditions which are not subject to changes in the course of time.

More particularly, the present invention relates to a device for removing from a surface on which a powdery developer has been deposited the excess developer particles which adhere to said surface. The device comprises a suction conduit with a port at each of two terminations. One of said ports, called the air inlet port is in the form of a slot and extends parallel to said surface in the immediate vicinity thereof. The other port, called the air outlet port, is connected to a suction source by means of a cylindrical chamber which is integral with said suction conduit. The invention is characterized in that the chamber is located such that its generators run parallel to the direction of elongation of the air inlet port of the conduit, and in that the two opposed side walls of said chamber each have a port, one of which, called the air inlet port, discharges into the atmosphere while the other, called the suction port, communicates with said suction source. The chamber furthermore includes on its cylindrical wall a third port which corresponds to the air outlet port of said conduit. The ratio of the cross-sectional area of said inlet port to that of said suction port ranges from 0.3 to 0.7, and the ratio of the cross-sectional area of said air inlet port to that of said inlet port ranging from 2 and 20.

BRIEF DESCRIPTION OF THE DRAWINGS

Other features, objects and advantages of the invention will be better understood from the consideration of the ensuing description by way of non-limitative example and from the attached drawings, wherein.

DESCRIPTION OF THE PREFERRED EMBODIMENTS

Figure 1:
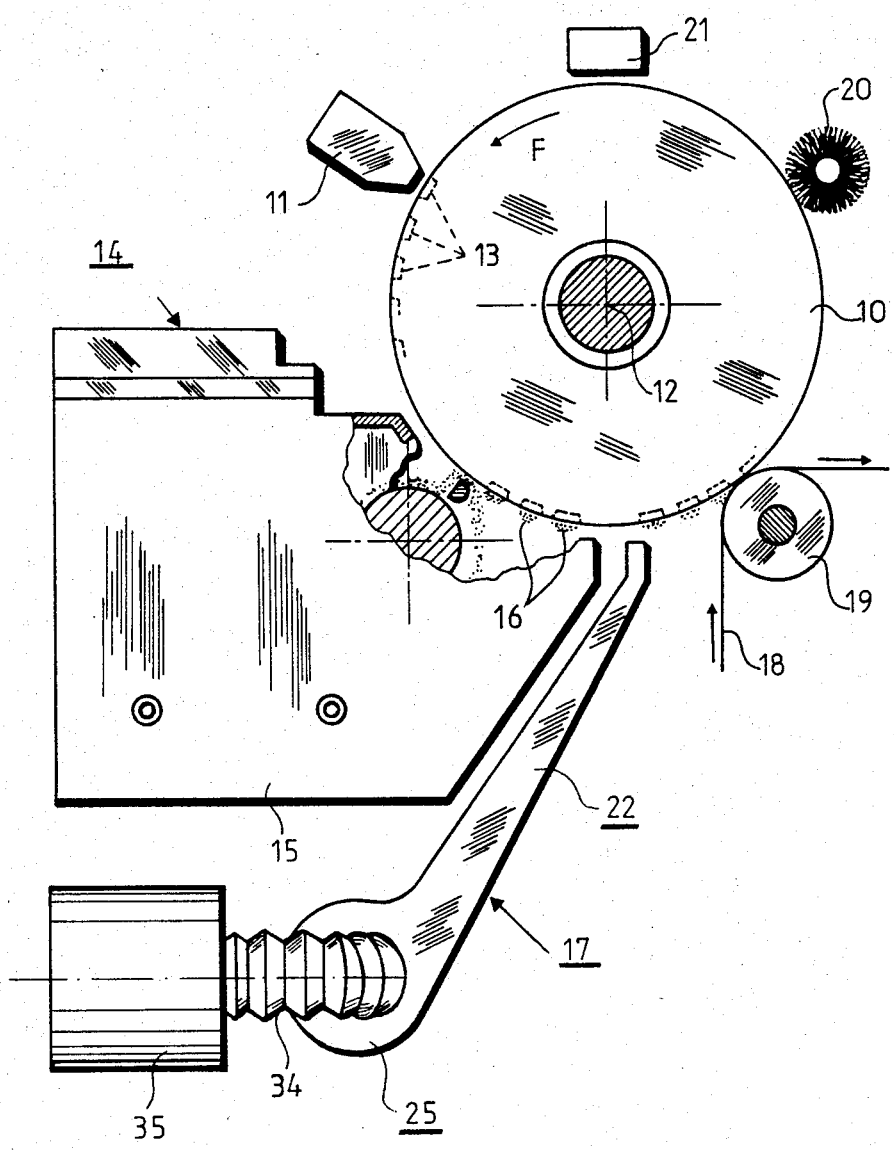
FIG. 1 is a partial schematic view of a printer having a device constructed according to the invention.

The printer, one part of which is shown schematically in FIG. 1, comprises a recording element which, in the example described is made up of a magnetic drum 10. This magnetic drum 10 is rotated in the direction of arrow F by an electric motor (not shown). The recording of information on this drum is effected by a magnetic recording unit 11 which is located near the outer surface of the drum. In the example described herein, recording unit 11 is made up of an assembly consisting of various magnetic recording heads which, arranged side by side, are aligned parallel to the axis of rotation 12 of drum 10. Each of these heads generates, when it is energized repeatedly by an electric current, a variable magnetic field which results in the creation of magnetized domains or "magnetic points" on the surface of the drum as it moves past recording unit 11. The instants of excitation of these heads are determined in known fashion so as to obtain on the surface of the drum groups of magnetized domains 13, called magnetized areas or latent magnetic images whose form corresponds to that of the characters to be printed. These magnetized areas 13 then move past an applicator means 14 which is located adjacent and underneath drum 10 and which enables particles of a powdery developer contained in a tank 15 to be applied to the surface of the drum. The developer particles which are thus applied to drum 10 adhere in principle only to the magnetized areas thereof, so that the magnetized areas which have moved past the applicator means 14 appear coated with a layer of the developer, said layer forming on drum 10 the image of the characters to be printed.

In the example described, this developer consists of magnetic particles coated with a resin which, through heating, is capable of melting and of being fixed on a sheet of paper on which it has been deposited. However, it should be pointed out that the nature of this developer is not specific of the invention and that in the case of an electrostatic printer to which the invention of course applies, this developer could very well consist of a powder as known from the prior art, which does not contain any magnetic particle. Likewise, to apply the developer to drum 10, any conventional applicator means could be employed.

In one particularly advantageous embodiment, the applicator means 14 shown in FIG. 1 is of the type that has been described and shown in the application for patent filed in France by the applicant on Feb. 11, 1982 under No. 82.02025. The developer adheres mainly to the magnetized areas 13, thus forming deposits 16 of particles on the surface of drum 10. These deposits 16 then move past a retouching device 17 whose function is to eliminate the particles that have adhered to locations other than the magnetized areas 13, as well as the excess particles on said areas. Thereupon, almost all of the developer particles that continue to exist on drum 10 are transferred to a sheet of paper 18 which is applied to drum 10 by means of a pressure roller 19. The residual developer particles which, after the transfer, are still on drum 10 are then dislodged by means of a cleaning device 20 known in the prior art, for example, a brush. Thereafter, the magnetized areas that have moved past the cleaning device 20 now move past an erasure means 21 where they are erased. This enables the demagnetized portions of drum 10 to be magnetized again when they move past the recording unit 11.

Figure 2:
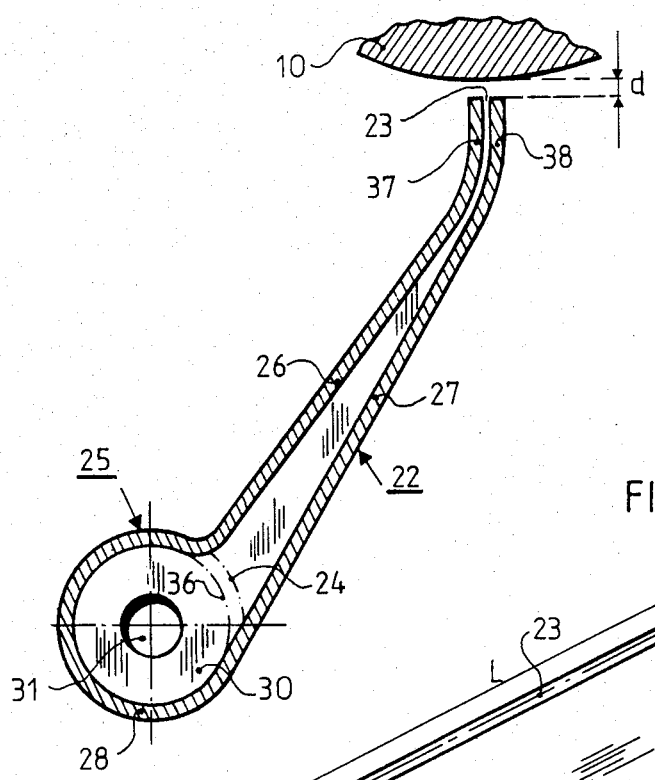
FIG. 2 is a cross-sectional view showing the internal structure of the device of the invention forming part of the printer of FIG. 1.
Figure 3:
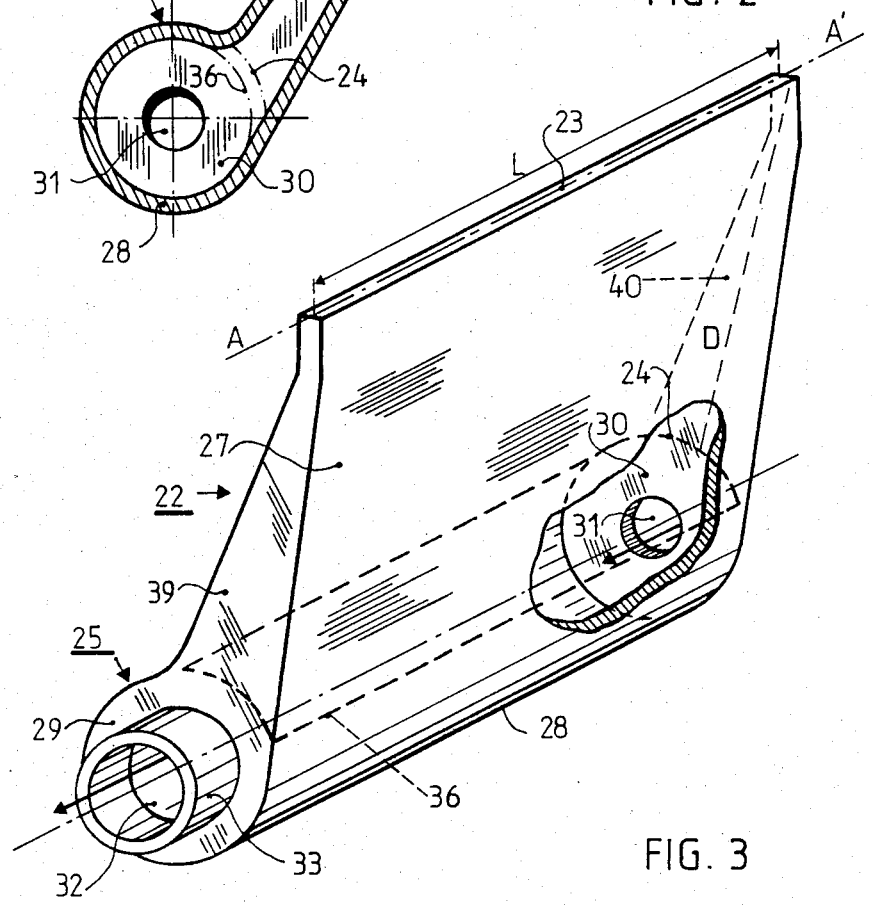
FIG. 3 is an enlarged perspective view of the device of the invention, said view being intended to show the arrangement of the principal constituent elements of the chamber forming part of this device.
Figure 5:
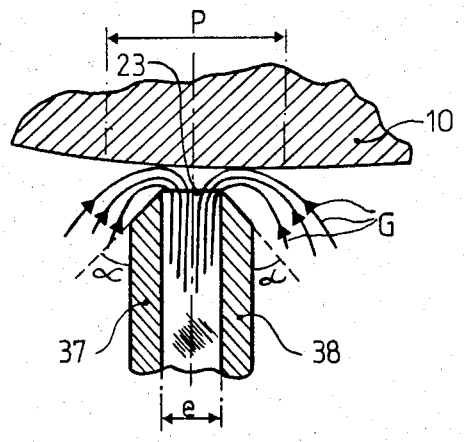
FIG. 5 is a detailed view, in section, of the device of FIG. 2.

The retouching device 17 shown in FIG. 1 comprises a suction conduit 22 which, as can be seen in FIGS. 2 and 3, terminates at each of its end portions in ports. One port 23, called an air inlet port, is located in the immediate vicinity of the surface of drum 10 and the other port, called air outlet port 24 and outlined by dash lines in FIG. 3, communicates with a chamber 25 which will be discussed hereinbelow. Air inlet port 23 has the form of a rectangular slot which extends in the direction of AA′ parallel to the rotational axis 12 of drum 10. The length L of said slot is substantially equal to that of said drum. The width e (FIG. 5) of port 23 is always very small in relation to its length L. More specifically, this width e is such that the ratio e is less than 0.006. The distance d (FIG. 2) which separates air inlet port 23 from the surface of the drum is itself very small and is 2 mm at the most.

Referring to FIGS. 2 and 3, suction conduit 22 has substantially the form of a right prism which is defined on one side by two triangular base plates 39 and 40, one parallel to the other, and, on the other side, by two non-parallel walls 26 and 27 positioned perpendicularly to said plates 39 and 40 converging toward air inlet port 23. The non-parallel walls 26 and 27 enclose an angle less than 30 degrees between each other. Under these conditions, the width of air outlet port 24 is always greater than that of air inlet port 23. The distance D separating the two ports 23 and 24 of suction conduit 22 is determined such that the width of air outlet port 24 remains betwen 5*e* and 20*e*. Thus, in the example described, where the width e of inlet port 23 is 1 mm, the width of outlet port 24 is substantially equal to 15 mm.

FIGS. 2 and 3 show that chamber 25 has the form of a cylinder which is delimited on one side by a cylindrical wall 28 and on the other side by two opposed side walls 29 and 30. It can be seen in FIGS. 2 and 3 that side wall 29 of the chamber and plate 30 of the suction conduit form only one piece. The same is true of side wall 30 of the chamber and of plate 40 of the conduit. However, if chamber 25 and suction line 22 were fabricated separately, then joined together in known fashion, for example, by welding, then wall 29 and plate 39, as well as wall 30 and plate 40 could very well be made up of two different pieces which are attached on one another during the joining together of the chamber and the conduit.

In the embodiment shown in FIGS. 1 and 3, the cylinder under which the chamber is shown is a cylinder of revolution, that is to say, that the conduit obtained by cutting this cylinder by a plane which is perpendicular to the axis or length of said cylinder is a circle. It should be pointed out, however, that this arrangement is not specific of the invention and that cylindrical chamber 25 could also take the form of a different cylinder, that is to say, that the cutting of the cylinder by a plane which is perpendicular to the axis or length of the chamber is no longer circular, but is limited by a non-circular close curve such as, for instance, an ellipse or a curve made up of two parallel line segments that are joined together at their ends by two portions of a circular conduit. A cylindrical chamber 25 whose cross section has precisely this last particular characteristic equips the retouching device shown by way of illustrative example in FIG. 4. It should, however, be pointed out that, as can be seen in FIGS. 3 and 4, the arrangement of cylindrical chamber 25 in relation to conduit 22 is such that its axis are parallel to the direction of elongation AA′ of air inlet port 23.

Figure 4:
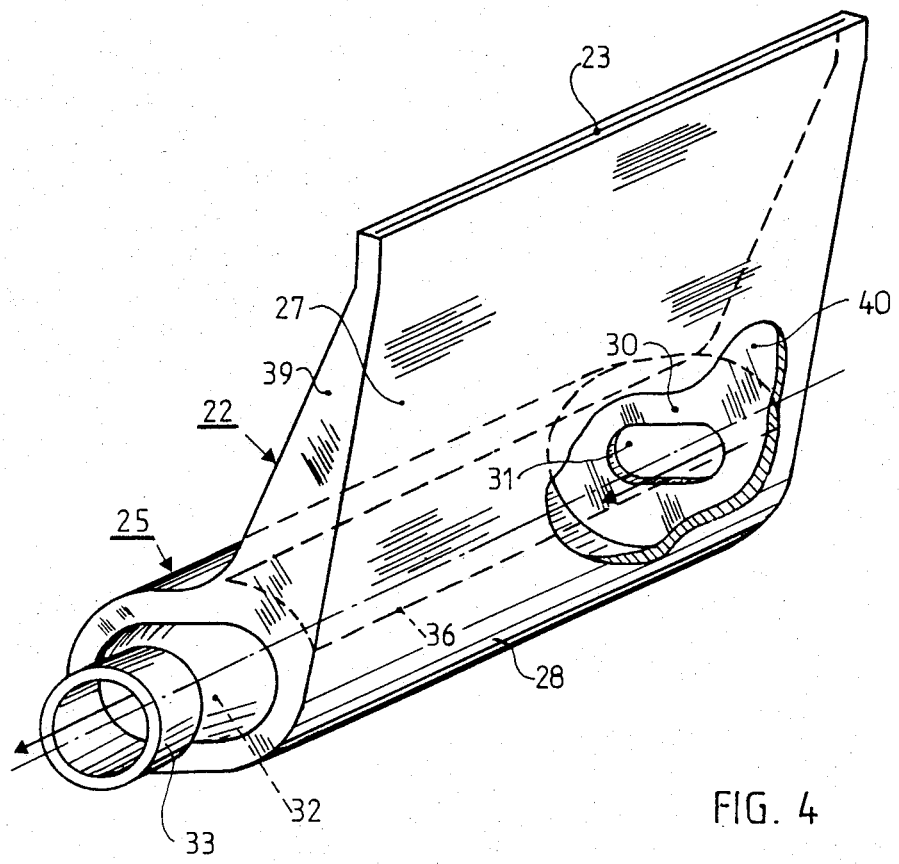
FIG. 4 shows a variant form of the device of FIG. 3.

FIGS. 3 and 4 show that side wall 30 of cylindrical chamber 25 has a port 31, called air inlet port, which discharges into the atmosphere, and that side wall 29 of said chamber has a port 32, called suction port, provided with a pipe end 33 to which there is usually attached a flexible conduit 34 to ensure, as shown in FIG. 1, the connection of chamber 25 to a suction source 35. On the other hand, as can be seen in FIGS. 2, 3 and 4, chamber 25 has on its cylindrical wall 28 a third port 36 which corresponds to the air outlet port 24 of suction conduit 22 and which, consequently, has the same dimensions as those of this outlet port.

The dimensions of suction port 32 are determined such that the ratio of the cross-sectional surface of the air inlet port 31 to that of said suction port 32 remains between 0.3 and 0.7. Likewise, the dimensions of air inlet port 31 are determined such that the ratio of the cross-sectional surface of air inlet port 23 to that of said inlet port remains between 2 and 20. Thus, in the example depicted in FIG. 3, where the cross section of air inlet port 23 is 400 $mm^2$, suction port 32 has a circular shape and has a diameter of 30 mm, that is to say, a cross section practically equal to 706 $mm^2$. Likewise, in the example considered here, air inlet port 31 has a circular shape and has a diameter of 15 mm, that is to say, a cross section practically equal to 176 $mm^2$. Furthermore, the dimensions of the third port 36 and, thus, those of outlet port 24 are determined such that the ratio of the cross-sectional surface of this third port to that of air inlet port 23 remains between 5 and 20. Thus, in the example considered above, this third port has a cross-section practically equal to 6,000 $mm^2$.

It should also be pointed out that the non-parallel walls 26 and 27 of suction conduit 22 have a relatively small thickness, usually less than 1 mm and are shaped as shown in FIG. 2 so that they have on either side of air inlet port 23 two terminating portions 37 and 38 which are parallel to one another and run perpendicularly to the surface of drum 10. Furthermore, in one preferred embodiment of the invention depicted in FIG. 5, the end of these terminating portions 37 and 38 is bevelled according to form an angle $\alpha$ which is equal to 45 degrees at the most. Under these circumstances, the air flow which arises when suction source 35 is put into operation follows a path which is illustrated schematically by means of arrows G in FIG. 5 and which is such that the length P, considered in a direction parallel to the direction of movement of drum 10, of the drum surface, which is subject to the action of this air flow, is relatively small and practically does not exceed three times the length e of air inlet port 23.

As a result, air flow works in the manner of an air wave oriented perpendicularly to the drum surface, so that its action differs completely from that of the air flow of the device described in the above-mentioned French Pat. No. 2,322,395 in which the air flow works in the manner of a shear, that is to say, parallel to the drum surface along a length at least equal to six times the width of the air inlet port. It should also be pointed out that the exhaustion capacity of suction source 35 may be adjusted by known devices (not shown), so that the value of the partial vacuum within suction conduit 22 remains between 1 and 4 millibars. It has been observed that when working under these conditions, no developer particles at all were deposited within the device which has just been described and that all the particles collected by this device were accumulated on the filters provided for this purpose downstream of chamber 25. It has also been determined that this device ensured a practically total elimination of the developer particles on the background areas of drum 10 without noticeably reducing the opacity of the characters formed by the deposit of the developer on the magnetized areas of this drum. These results are illustrated by the values shown in the table below which indicates the values of the optical density of the background and of the optical density within each character as a function of the value of the partial vacuum p inside the suction conduit, said partial vacuum representing the disparity between the value of the atmospheric pressure and the value of the pressure (lower than that of the atmosphereic pressure which is established within line 22 when suction source 35 is put into operation.

| P (millibars) | Optical density of background | Optical density within each character |
|---|---|---|
| 0 | 0.1 | 1.15 |
| 0.2 | 0.09 | 1.15 |
| 0.5 | 0.08 | 1.14 |
| 1 | 0.07 | 1.13 |
| 2 | 0.058 | 1.12 |
| 3 | 0.054 | 1.10 |
| 4 | 0.051 | 1.09 |

It is fitting to point out here that the optical densities indicated in this table are those that have been measured by means of a densitometer after the image of the characters formed by the deposit on the developer on the drum has been transferred onto the paper. This paper, when it is blank, has an optical density which is practically equal to 0.05. In addition, these optical density values are those that are obtained for a drum rate of 31.4 cm/s when for the development of the latent images of this drum a developer is employed of the type described in the application for patent filed in France by the applicant on Mar. 20, 1980 and published under No. 2,478,839.

Figure 6:
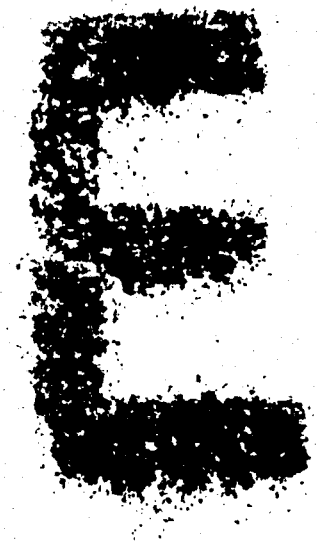
FIG. 6 is a picture showing the appearance of a character printed by the machine when the device of the invention is not functioning.
Figure 7:
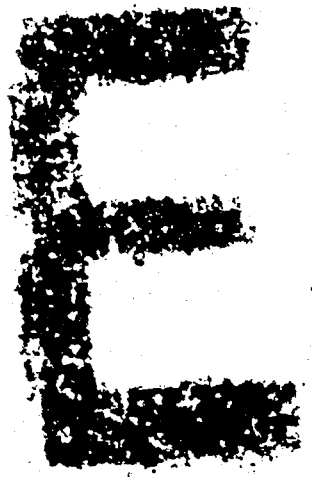
FIG. 7 is a picture showing the appearance of the same character when the device of the invention is in operation.

Thus, it can be seen, according to the values indicated in the above table, that for partial vacuum values ranging from 1 to 4 millibars the optical density of the background is close to that of the blank paper. In particular, for the partial vacuum values in the neighborhood of 4 millibars, practically all of the developer on the background areas of the paper is eliminated. It can also be seen that for the partial vacuum values between 1 and 4 millibars, the optical density within each character varies very little so that the variations observed in the opacity of each character are practically negligible. It must also be pointed out that the device of the invention, when used under the conditions described above, improves considerably the sharpness of the characters, as can be seen in the pictures shown in FIGS. 6 and 7. The picture in FIG. 6 shows the appearance, on a larger scale, of a character when the device of the invention is not in operation. The picture of FIG. 7 shows the appearance of the same character when this device is used under the conditions described hereinabove.

While particular embodiments of the invention have been shown and described, it will be understood that the invention is not limited to these embodiments which have been set forth for purposes of illustration only. On the contrary, it includes all the means that constitute technical equivalents to those shown and described herein, taken separately or jointly and carried into effect within the scope of the appended claims.

1. In a device for removing excess developer particles adhering to a surface upon which a powdery developer has been deposited, said device comprising:

a suction conduit (22) having a port at each of two terminations, one of said ports being a first air inlet port (23) shaped in the form of a slot and running parallel to said surface in the immediate vicinity thereof, the other port being an air outlet port (24);

and a cylindrical chamber (25) integral with said suction conduit (22), and located at said outlet port (24) with an axis running parallel to the direction of elongation (AA') of said first inlet port (23), said cylindrical chamber having side walls (29, 30) one of which (29) has a suction port (32) communicating with a suction source (35), said chamber (25) further having on its cylindrical wall (28) a port (36) which corresponds to the air outlet port (24) of said suction conduit;

the improvement comprising the other of said side walls (30) of said chamber (25) having a second air inlet port (31) communicating with the atmosphere, and wherein the ratio of the cross-sectional area of said first air inlet port (23) to that of said suction port (32) ranges from 0.3 to 0.7 and the ratio of the cross-sectional area of said first air inlet port (23) to that of said second air inlet port (31) ranges from 2 to 20.

2. The device as in claim 1, wherein said chamber (25) has the form of a cylinder of revolution.

3. The device as in claim 2, wherein the maximum distance separating the first air inlet port (23) from said surface is two millimeters.

4. The device as in claim 3, wherein the first air inlet port (23) has the form of a rectangular slot, the ratio of the width (e) to the length (L) of said slot being less than 0.006.

5. The device as in claim 4, wherein the suction conduit (22) is shaped substantially in the form of a right prism which is delimited, on one side, by two triangular base plates (3, 40) parallel to one another and, on the other side, by two non-parallel walls (26, 27) perpendicular to said plates and converging toward the first air inlet port (23), said non-parallel walls enclosing an angle of less than 30 degrees between one another.

6. The device as in claim 2, wherein the first air inlet port (23) has the form of a rectangular slot, the ratio of the width (e) to the length (L) of said slot being less than 0.006.

7. The device as in claim 6, wherein the suction conduit (22) is shaped substantially in the form of a right prism which is delimited, on one side, by two triangular base plates (3, 40) parallel to one another and, on the other side, by two non-parallel walls (26, 27) perpendicular to said plates and converging toward the first air inlet port (23), said non-parallel walls enclosing an angle of less than 30 degrees between one another.

8. The device as in claim 1, wherein the maximum distance separating the first air inlet port (23) from said surface is two millimeters.

9. The device as in claim 8, wherein the first air inlet port (23) has the form of a rectangular slot, the ratio of the width (e) to the length (L) of said slot being less than 0.006.

10. The device as in claim 9, wherein the suction conduit (22) is shaped substantially in the form of a right prism which is delimited, on one side, by two triangular base plates (3, 40) parallel to one another and, on the other side, by two non-parallel walls (26, 27) perpendicular to said plates and converging toward the first air inlet port (23), said non-parallel walls enclosing an angle of less than 30 degrees between one another.

11. The device as in claim 8 wherein the exhausting capacity of the suction source (35) is set such that the value of the partial vacuum within the suction conduit (22) is between 1 and 4 millibars.

12. The device as in claim 1, wherein the first air inlet port (23) has the form of a rectangular slot, the ratio of the width (e) to the length (L) of said slot being less than 0.006.

13. The device as in claim 12, wherein the suction conduit (22) is shaped substantially in the form of a right prism which is delimited, on one side, by two triangular base plates (3, 40) parallel to one another and, on the other side, by two non-parallel walls (26, 27) perpendicular to said plates and converging toward the first air inlet port (23), said non-parallel walls enclosing an angle of less than 30 degrees between one another.

14. The device as in claim 13, wherein the width of the air outlet port (24) ranges between 5*e* and 20*e*, e being the width of the first air inlet port (23).

15. The device as in claim 13, wherein the non-parallel walls (26, 27) have two terminating portions (37, 38), whose ends are bevelled at an angle not greater than 45 degrees.

16. The device as in claim 13, wherein the exhausting capacity of the suction source (35) is set such that the value of the partial vacuum within the suction conduit (22) is between 1 and 4 millibars.

17. The device as in claim 12, wherein the exhausting capacity of the suction source (35) is set such that the value of the partial vacuum within the suction conduit (22) is between 1 and 4 millibars.

18. The device as in claim 1, wherein the exhausting capacity of the suction source (35) is set such that the value of the partial vacuum within the suction conduit (22) is between 1 and 4 millibars.

19. The device as in claim 1, wherein the first air inlet port (23) has the form of a rectangular slot, the ratio of the width (3) to the length (L) of said slot being less than 0.006 and the width of the air outlet port (24) ranges between 5*e* and 20*e*.

20. The device as in claim 19, wherein the exhausting capacity of the suction source (35) is set such that the value of the partial vacuum within the suction conduit (22) is between 1 and 4 millibars.

* * * * *